US008075661B2

(12) United States Patent
Chen et al.

(10) Patent No.: US 8,075,661 B2
(45) Date of Patent: Dec. 13, 2011

(54) ULTRA-HARD COMPOSITE MATERIAL AND METHOD FOR MANUFACTURING THE SAME

(75) Inventors: Chi-San Chen, Changhua County (TW); Chih-Chao Yang, Tainan (TW); Jien-Wei Yeh, Hsinchu (TW); Chin-Te Huang, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 561 days.

(21) Appl. No.: 12/110,019

(22) Filed: Apr. 25, 2008

(65) Prior Publication Data

US 2009/0074604 A1 Mar. 19, 2009

(30) Foreign Application Priority Data

Sep. 19, 2007 (TW) ..... 96134825 A

(51) Int. Cl.
*C22C 29/08* (2006.01)
*C22C 29/10* (2006.01)
*B22F 3/12* (2006.01)

(52) U.S. Cl. ..... 75/236; 75/240; 419/14; 419/18; 419/32; 419/38; 419/57; 419/60

(58) Field of Classification Search ..... 419/14, 419/32, 18, 38, 57, 60; 75/236, 240
See application file for complete search history.

(56) References Cited

U.S. PATENT DOCUMENTS

| | | | |
|---|---|---|---|
| 6,030,912 | A | 2/2000 | Yamamoto et al. |
| 6,241,799 | B1 | 6/2001 | Galli |

FOREIGN PATENT DOCUMENTS

| | | |
|---|---|---|
| CN | 1548567 | 11/2004 |
| CN | 1554789 | 12/2004 |
| CN | 1718813 | 1/2006 |
| CN | 1827817 | 9/2006 |
| JP | 8319532 | 12/1996 |
| JP | 10110235 | 4/1998 |
| TW | 567230 | 12/2003 |
| WO | WO2004065645 | 8/2004 |

OTHER PUBLICATIONS

CN1827817. Machine translation.*

* cited by examiner

*Primary Examiner* — Roy King
*Assistant Examiner* — Ngoclan Mai
(74) *Attorney, Agent, or Firm* — Muncy, Geissler, Olds & Lowe, PLLC

(57) ABSTRACT

An ultra-hard composite material and a method for manufacturing the same, including mixing a metal carbide powder and a multi-element high-entropy alloy powder to form a mixture, green compacting the mixture, and sintering the mixture to form the ultra-hard composite material. The described multi-element high-entropy alloy consists of five to eleven principal elements, with every principal element occupying a 5 to 35 molar percentage of the alloy.

12 Claims, 9 Drawing Sheets

ULTRA-HARD COMPOSITE MATERIAL AND METHOD FOR MANUFACTURING THE SAME

BACKGROUND OF THE INVENTION

1. Field of the Invention

The present invention relates to ultra-hard composite materials, and in particular relates to compositions of binder metals thereof.

2. Description of the Related Art

Since early 1920, ultra-hard composite materials have been widely applied in industry due to excellent properties such as high hardness, high thermal resistance, and high grinding resistance. One type of composite material, carbide, is popularly used and roughly divided into two types: tungsten carbide (hereinafter WC) based composite materials and titanium carbide (hereinafter TiC) based composite materials. The ultra-hard composite materials are composed of two different compositions. The first composition is ceramic phase powder with high melting point, high hardness, and high brittleness, such as carbide (tungsten carbide, titanium carbide, vanadium carbide, niobium carbide, chromium carbide, or tantalum carbide), carbonitride, borate, boride, or oxide. The second composition is binder metal with low hardness and high toughness. For example, the major binder metal for WC based composite material is cobalt. Alternatively, the major binder metal for TiC based composite material is nickel or nickel-molybdenum alloy. The method for manufacturing the ultra-hard composite materials is powder metallurgy. The binder metal transforms to a liquid state and further forms an eutectic liquid phase with the carbide under sintering temperature. Furthermore, the carbide powder is wrapped, cohered, and contracted by capillary motion to achieve high sintering density. For enhancing the sintering density, the ultra-hard composite materials are further processed by press sintering or hot isostatic pressing, such that advantages such as high hardness and high grinding resistance of the carbide and toughness of the binder metal are combined in ultra-hard composite materials.

The described ultra-hard composite materials are generally utilized in cutters, molds, tools, and grinding resistant device, such as turning tools, mills, reamers, planar tools, saws, drills, punches, shearing molds, shaping mold, drawing molds, extruding mold, watch sections, or the ball of pens. The WC ultra-hard composite material is most widely applied. The component ratio of the composite material is defined by requirement. Although a lower binder metal ratio combined with a higher carbide ratio produces a composite material having higher hardness and grinding resistance, it also causes the composite material to have lower toughness and higher brightness. If hardness and grinding resistance is mostly required, the carbide ratio should be enhanced. If toughness is more important, the carbide ratio should be reduced. In addition, if the device is used in corrosive conditions or high temperatures, the device should be anti-corrosive and anti-oxidative. The different requirements have been driven by the advancement of society, such that current production trends include higher yields, longer operating lifespan, and lower product costs of products such as cutters, molds, tools, and grinding resistant devices. Nonetheless, the toughness, thermal resistance, grinding resistance, anti-corrosiveness, and anti-adherence for traditional WC and TiC carbide ultra-hard composite materials are usually deficient when applied to different applications.

The binder metal of the traditional WC ultra-composite material is a cobalt based alloy with few amounts of iron and nickel. In Japan patent No. 8,319,532, the punch material is a WC based composite with binder metal (5-15 wt %) of a nickel based alloy. The nickel based alloy also includes 1-13 wt % $Cr_3C_2$. In Japan patent No. 10,110,235, the binder metal of the WC composite material is an iron based alloy, and the alloy further includes vanadium, chromium, vanadium carbide, and chromium carbide. In U.S. Pat. No. 6,030,912, the metal binder of WC and $W_2C$ composite material is 0.02-0.1 wt % metal such as iron, cobalt, nickel, and the likes and 0.3-3 wt % carbide, nitride, and carbonitride of transition metal of IVA, VA, and VIA groups. In U.S. Pat. No. 6,241,799, the sintering metal of WC is cobalt and/or nickel. In the binder metal formula, the cobalt is 90 wt % at most, the nickel is 90 wt % at most, the chromiun is 3-15 wt % at most, the tungsten is 30 wt % at most, and molybdenum is 15 wt % at most, restricting the WC crystal growth during sintering.

Presently, China is the largest consumer of WC ultra-hard composite materials. Therefore, a large number of WC ultra-hard composite material patents have been disclosed in China improving properties such as strength, hardness, toughness, and grinding resistance. In China Pat. No. CN 1,548,567, high-manganese steel serves as the binder metal of a WC composite. The high-manganese steel is composed of 14-18 wt % manganese, 3-6 wt % nickel, 0.19-1.9 wt % carbon, and 74.1-82.1 wt % iron. This WC composite has high strength, high hardness, and high grinding resistance. In addition, carbide may serve as part of the binder metal. In China Pat. No. 1,554,789, the binder metal includes 4-6 wt % cobalt and 0.3-0.6 wt % tantalum. The binder metal is sintered with a WC powder to form a WC composite material with higher grinding resistance and higher toughness. Furthermore, in China Pat. No. 1,718,813, the binder metal includes 7-9 wt % of cobalt, 0.1-0.5 wt % vanadium carbide, and 0.3-0.7 wt % of chromium carbide. The binder metal is sintered with a WC powder to form a WC composite material with high strength, high hardness, and high toughness.

Accordingly, the conventional metal binder has one metal or a combination of two metals as a major part (>50 wt %) doped with other metal elements and a carbide ceramic phase. However, the binder metal of the invention is a high-entropy alloy disclosed in Taiwan Pat. No. 193729. For the invention, the multi-element high-entropy alloy powder consists of five to eleven principal elements, with every principal element occupying a 5 to 35 molar percentage of the multi-element high-entropy alloy powder. The concept and effect of the multi-element high-entropy alloy is disclosed in Advanced Engineering Materials, 6, 299-303 (2004) by one inventor of the invention, Yeh. The paper discloses a high-entropy alloy composed of at least five principal elements, with every principal element occupying a 5 to 35 molar percentage of the high-entropy alloy. The binder metal composed of high-entropy alloy shows characteristics such as high-entropy effect, sluggish effect, lattice distortion effect, and cocktail effect, and has thermal resistance and hardness, such that the composite utilizing the binder metal has high hardness, high thermal resistance, and high grinding resistance. Additionally, because the sluggish effect of the high-entropy alloy makes the sintered binder metal during the liquid phase difficult to be transferred or diffused and prevents crystal growth of WC or TiC, hardness, toughness, thermal resistance, and grinding resistance of the sintered composite are not reduced. Moreover, because part of the elements in the binder metal combines with carbon to form carbides, hardness of the composite is increased. For the invention, nickel and chromium in the binder metal enhances anti-corrosive properties of the composite, chromium, aluminum, and silicon in the binder metal increases anti-oxidation, and copper in the binder metal increases lubricity of the composite. For the invention, the composite performance and operating lifespan can be adjusted by appropriate molar ratio and element type. Compared to the invention, the conventional binder metal is composed of fewer elements with less variation, thereby limiting the performance of the composite material.

BRIEF SUMMARY OF THE INVENTION

The invention provides a method for manufacturing an ultra-hard composite material, comprising mixing at least one ceramic phase powder and a multi-element high-entropy alloy powder to form a mixture, green compacting the mixture, and sintering the mixture to form an ultra-hard composite material, wherein the multi-element high-entropy alloy powder consists of five to eleven principal elements with every principal element occupying a 5 to 35 molar percentage of the multi-element high-entropy alloy powder.

The invention also provides an ultra-hard composite material, comprising (a) at least one ceramic phase powder, and (b) a multi-element high-entropy alloy powder, wherein the multi-element high-entropy alloy powder consists of five to eleven principal elements, with every principal element occupying a 5 to 35 molar percentage of the multi-element high-entropy alloy powder.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
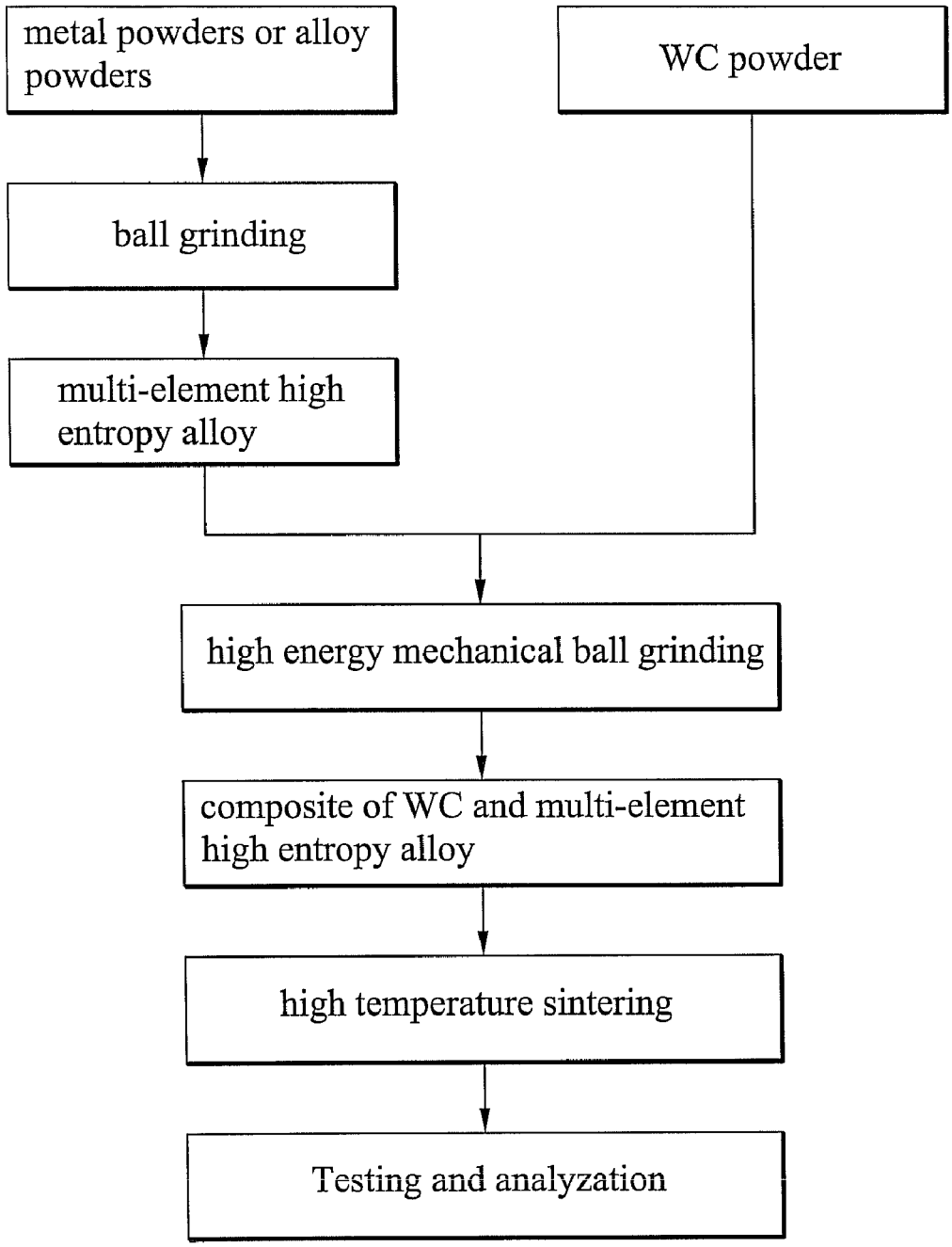
FIG. 1 shows the process flow of the invention.

The following description is of the best-contemplated mode of carrying out the invention. This description is made for the purpose of illustrating the general principles of the invention and should not be taken in a limiting sense. The scope of the invention is best determined by reference to the appended claims.

For the invention, a multi-element high-entropy alloy serves as a binder metal combined with ceramic phase powder (such as WC, TiC, and the likes) to improve the ultra-hard composite material properties, thereby extending operating lifespan of different applications. One inventor of the invention, Yeh, disclosed a high-entropy alloy in Taiwan Pat. No. 193729. The multi-element high-entropy alloy powder consists of five to eleven principal elements, with every principal element occupying a 5 to 35 molar percentage of the multi-element high-entropy alloy powder. The concept and effect of the multi-element high-entropy alloy is disclosed in Advanced Engineering Materials, 6, 299-303 (2004), by Yeh. In the paper, the high entropy alloy consists of at least 5 elements, and each element occupies 5 to 35 molar percentage of the high entropy alloy. The high entropy alloy can be formed by melting and casting, forging, or powder metallurgy. Because the high entropy alloy with characters such as high-entropy effect, sluggish effect, lattice distortion effect, and cocktail effect has thermal resistance and hardness, such that the composites utilizing this binder metal also have high thermal resistance. Next, the sluggish effect of the high-entropy alloy makes the sintered binder metal in liquid phase difficult to transfer or diffuse to prevent the crystal growth of WC or TiC, such that the hardness, toughness, thermal resistance, and grinding resistance of sintered composite are not reduced. In addition, part of elements in binder metal combine with carbon form carbides, thereby increasing the hardness of the composite. In this invention, nickel and chromium in binder metal may enhance the anti-corrosion of the composite; and chromium, aluminum, and silicon in binder metal may increase anti-oxidation. Accordingly, the high-entropy alloy provides different properties, thus increasing application of the composite.

For the invention, sintering properties are improved by mechanical alloying, such that a fine ceramic phase powder is evenly dispersed. For the mechanical alloying process, powders are mixed, cold welded, cracked, and re-cold welded by high energy ball grinding or impacting to complete the alloying and combining mixture process. Due to mechanical alloying, the mixed powders of the invention, such as element powders with metal carbide ceramic phase powders, alloy powders with metal carbide ceramic phase powders, or element powders, alloy powders and metal carbide ceramic phase powders together, have the following several properties: (1) alloyed element powders; (2) fine carbide ceramic phase powders; and (3) same component fine sized alloy powders and a binder metal evenly wrapping the carbide ceramic phase powder surface. For the invention, the ceramic phase powder and the multi-element high-entropy alloy powder have a weight ratio of 5:95 to 40:60.

The sintering process of the ceramic phase powder/high-entropy alloy ultra-hard composite material of the invention is similar to the sintering process of conventional WC/Co ultra-hard composite material, such as debinding, degassing, sintering or liquid-phase sintering, and cooling for completion. Optionally, the mixture can be pre-sintered at a lower temperature, cut or worked to an appropriate shape, and re-sintered for completion. For enhancing sintering density, the sintering process may further include press sintering or hot isostatic pressing after sintering. The steps such as debinding, degassing, and sintering can be processed in a vacuum chamber or under a mixing gas of argon, hydrogen, and the likes. The sintering temperature is adjusted, dependent upon the binder metal component. In one embodiment, the liquid-phase sintering is excellent at 1300-1500° C. In one embodiment, the ultra-hard composite material manufactured by the described process includes at least one ceramic phase powder and the multi-element high-entropy alloy, wherein the multi-element high-entropy alloy consists of five to eleven principal elements, with every principal element occupying a 5 to 35 molar percentage of the multi-element high-entropy alloy powder. The described ceramic phase powder and the multi-element high-entropy alloy powder have a weight ratio of 5:95 to 40:60. In one embodiment, the ultra-hard composite material has a hardness of Hv 800 to Hv 2400.

EXAMPLES

Example 1

FIG. 1 shows the sintering process of Example 1. First, several pieces of pure metal or alloy powder were ball grinded to form a multi-element high-entropy alloy powder. Second, different ratios of the multi-element high-entropy alloy powder and WC powder were mixed and ball grinded to form evenly mixed powders. Subsequently, the WC/multi-element high-entropy alloy mixtures were green compacted, and sintered at a high temperature to form ultra-hard composite materials. Lastly, the composite materials were tested and analyzed. In Example 1, the high-entropy alloy powders were composed of aluminum, chromium, copper, iron, manganese, titanium, and vanadium. The component ratios of A serial alloys according to Taguchi's method ($L_8 2^7$) as an orthogonal array were tabulated as in Table 1.

TABLE 1

| Alloy serial No. | component | Al | Cr | Cu | Fe | Mn | Ti | V |
|---|---|---|---|---|---|---|---|---|
| A1 | Molar ratio | 1 | 1 | 1 | 1 | 1 | 1 | 1 |
| | Molar percentage | 14.28 | 14.28 | 14.28 | 14.29 | 14.29 | 14.29 | 14.29 |
| A2 | Molar ratio | 1 | 1 | 1 | 0.2 | 0.2 | 0.2 | 0.2 |
| | Molar percentage | 26.32 | 26.32 | 26.32 | 5.26 | 5.26 | 5.26 | 5.26 |
| A3 | Molar ratio | 1 | 0.2 | 0.2 | 1 | 1 | 0.2 | 0.2 |
| | Molar percentage | 26.32 | 5.26 | 5.26 | 26.32 | 26.32 | 5.26 | 5.26 |
| A4 | Molar ratio | 1 | 0.2 | 0.2 | 0.2 | 0.2 | 1 | 1 |
| | Molar percentage | 26.32 | 5.26 | 5.26 | 5.26 | 5.26 | 26.32 | 26.32 |
| A5 | Molar ratio | 0.2 | 1 | 0.2 | 1 | 0.2 | 1 | 0.2 |
| | Molar percentage | 5.26 | 26.32 | 5.26 | 26.32 | 5.26 | 26.32 | 5.26 |
| A6 | Molar ratio | 0.2 | 1 | 0.2 | 0.2 | 1 | 0.2 | 1 |
| | Molar percentage | 5.26 | 26.32 | 5.26 | 5.26 | 26.32 | 5.26 | 26.32 |
| A7 | Molar ratio | 0.2 | 0.2 | 1 | 1 | 0.2 | 0.2 | 1 |
| | Molar percentage | 5.26 | 5.26 | 26.32 | 26.32 | 5.26 | 5.26 | 26.32 |
| A8 | Molar ratio | 0.2 | 0.2 | 1 | 0.2 | 1 | 1 | 0.2 |
| | Molar percentage | 5.26 | 5.26 | 26.32 | 5.26 | 26.32 | 26.32 | 5.26 |

Note:

as the sum of the molar percentages should equal to 100, number rounding was implemented to the nearest hundredth.

Figure 2:
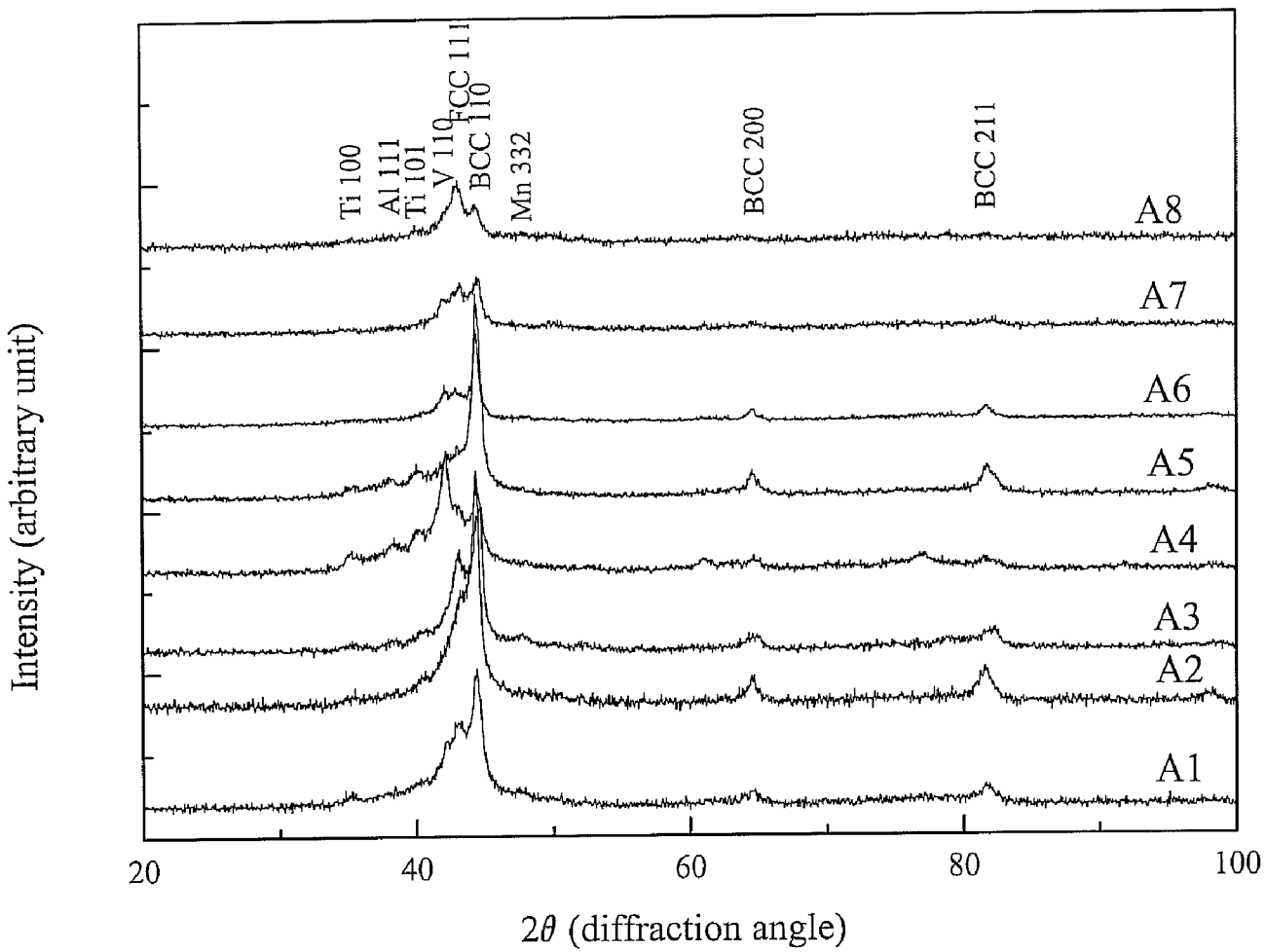
FIG. 2 shows the X-ray diffraction diagrams of the multi-element high-entropy alloy powders A1-A8.

The different element powder ratios were ball grinded for 18 hours to form the multi-element high-entropy alloy powders. FIG. 2 shows the X-ray diffraction diagrams of the multi-element high-entropy alloy powders, and the diagrams reveal the alloy powders having a certain degree of alloying phenomenon. The WC powder ratios were then mixed with the multi-element high-entropy alloy powders as shown in Table 2. The mixtures were ball grinded, green compacted, and sintered to form ultra-hard composite materials, with composite material hardness tabulated as in Table 2. The composite material hardness can be adjusted by changing the ratio of the high-entropy alloy and the WC for required applications.

TABLE 2

| Testing sample No. | Alloy powder weight ratio | WC powder ratio | Hardness (Hv) |
|---|---|---|---|
| A1W-20 | 20% A1 | 80% | 1312 |
| A2W-20 | 20% A2 | 80% | 1405 |
| A3W-20 | 20% A3 | 80% | 1352 |
| A4W-20 | 20% A4 | 80% | 1607 |
| A5W-20 | 20% A5 | 80% | 1423 |
| A6W-20 | 20% A6 | 80% | 1501 |
| A7W-20 | 20% A7 | 80% | 1532 |
| A8W-20 | 20% A8 | 80% | 1468 |

Example 2

Figure 3:
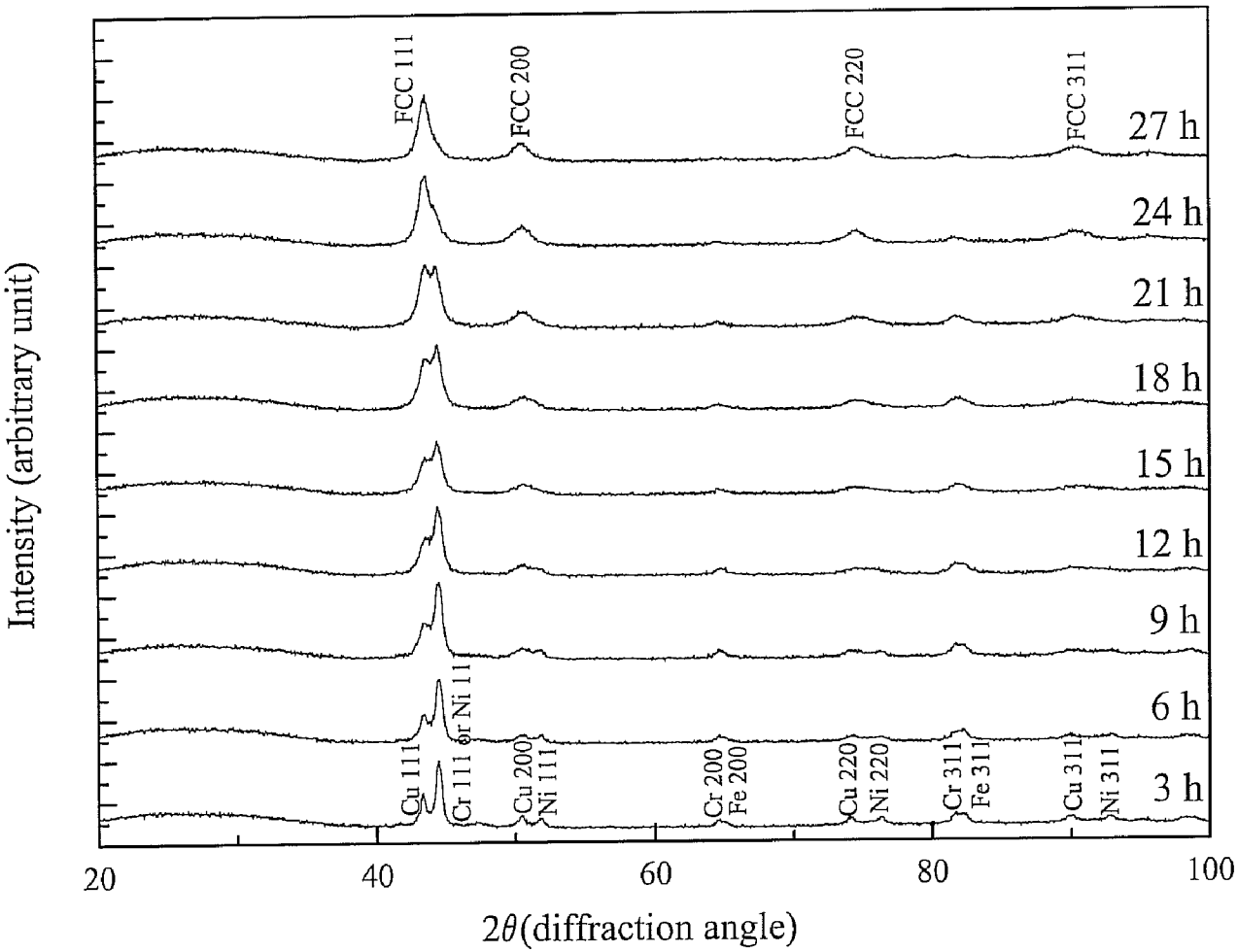
FIG. 3 shows the X-ray diffraction diagram of the multi-element high-entropy alloy powders B1 after different ball grinding periods.

FIG. 1 also shows the sintering process of Example 2. Six element powders such as aluminum, chromium, cobalt, copper, iron, and nickel were ball grinded to form the multi-element high-entropy alloy powder. The component ratios of B serial alloys were tabulated as in Table 3. For of the B2 powder example, the relation between the ball grinding time and the crystal structure was analyzed by X-ray diffraction, whereby a diagram is shown in FIG. 3. In reference to FIG. 3, complete alloying, such as a single FCC phase solid solution, can be achieved by at least 24 hours of ball grinding.

TABLE 3

| Alloy serial No. | Component | Al | Cr | Co | Cu | Fe | Ni |
|---|---|---|---|---|---|---|---|
| B1 | Molar ratio | 0.3 | 1 | 1 | 1 | 1 | 1 |
| | Molar percentage | 5.70 | 18.86 | 18.86 | 18.86 | 18.86 | 18.86 |
| B2 | Molar ratio | 0.5 | 1 | 1 | 1 | 1 | 1 |
| | Molar percentage | 9.1 | 18.18 | 18.18 | 18.18 | 18.18 | 18.18 |
| B3 | Molar ratio | 0.8 | 1 | 1 | 1 | 1 | 1 |
| | Molar percentage | 13.80 | 17.24 | 17.24 | 17.24 | 17.24 | 17.24 |

Figure 4:
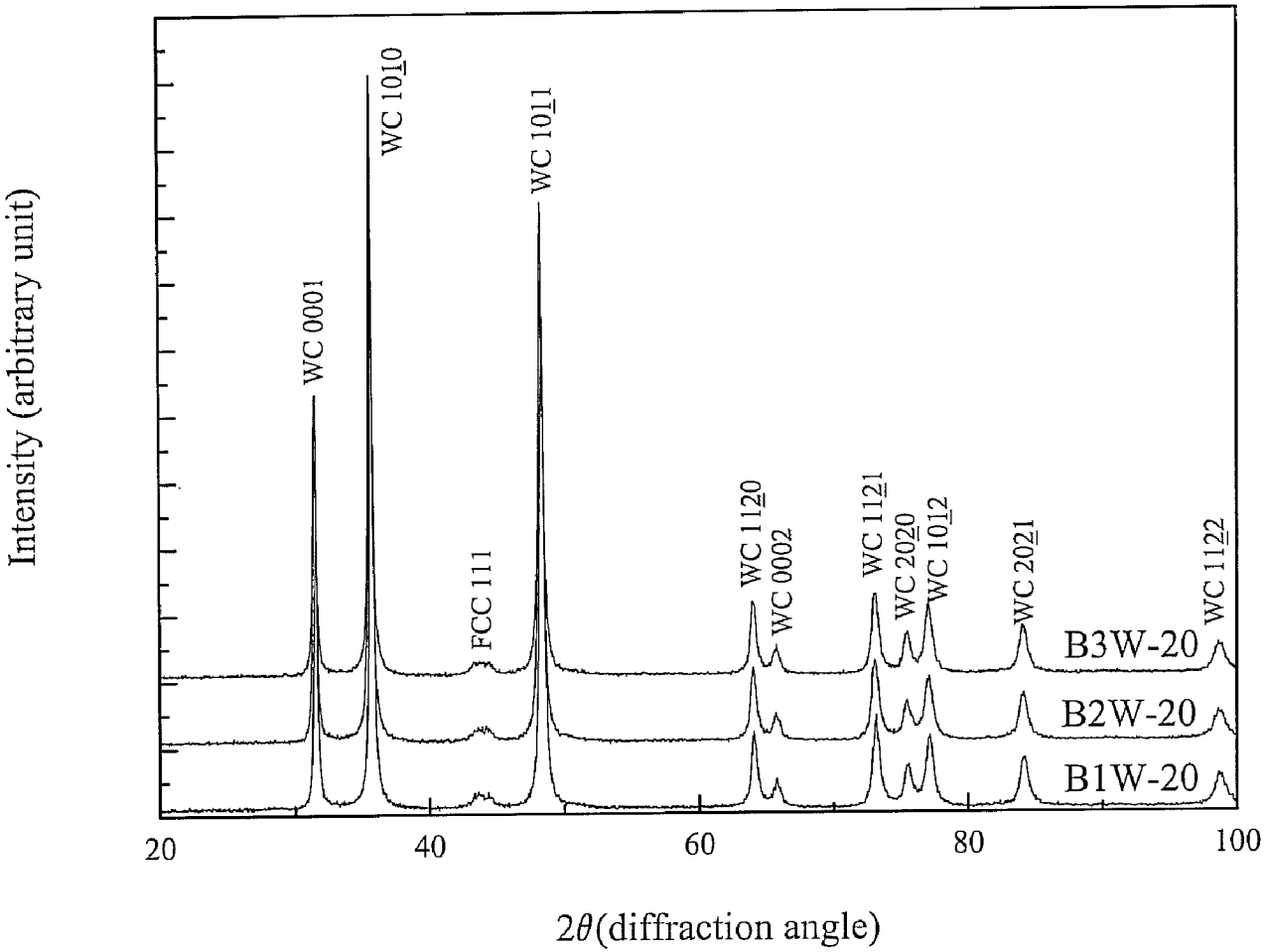
FIG. 4 shows the X-ray diffraction diagrams of mixtures, composed of different ratios of B serial alloys and WC powder, after ball grinding.

Table 4 shows the mixtures composed of different ratios of B serial alloys and WC powder. FIG. 4 shows X-ray diffraction results of the mixture in Table 4. FIG. 4 shows that the mixture has a WC mixing phase and single FCC mixing phase. The mixing phases also occur in other mixtures.

TABLE 4

| Testing sample No. | Alloy powder weight ratio | WC powder ratio |
|---|---|---|
| B1W-20 | 20% B1 | 80% |
| B2W-20 | 20% B2 | 80% |
| B3W-20 | 20% B3 | 80% |

After green compacting, the sintering conditions of the mixtures were tabulated as in Table 5.

TABLE 5

| Heating region(° C.) | Heating ratio (° C./min) | Remaining temperature period (min) | Sintering atmosphere |
|---|---|---|---|
| Room temperature to 300 | 3 | 30 | Ar + 10 wt % $H_2$ |
| 300~500 | 3 | 60 | Ar + 10 wt % $H_2$ |
| 500~1250 | 6 | 30 | Vacuum |
| 1250~1385 | 3 | 60 | Vacuum |
| 1385 to room temperature | cooling | — | vacuum |

Figure 5:
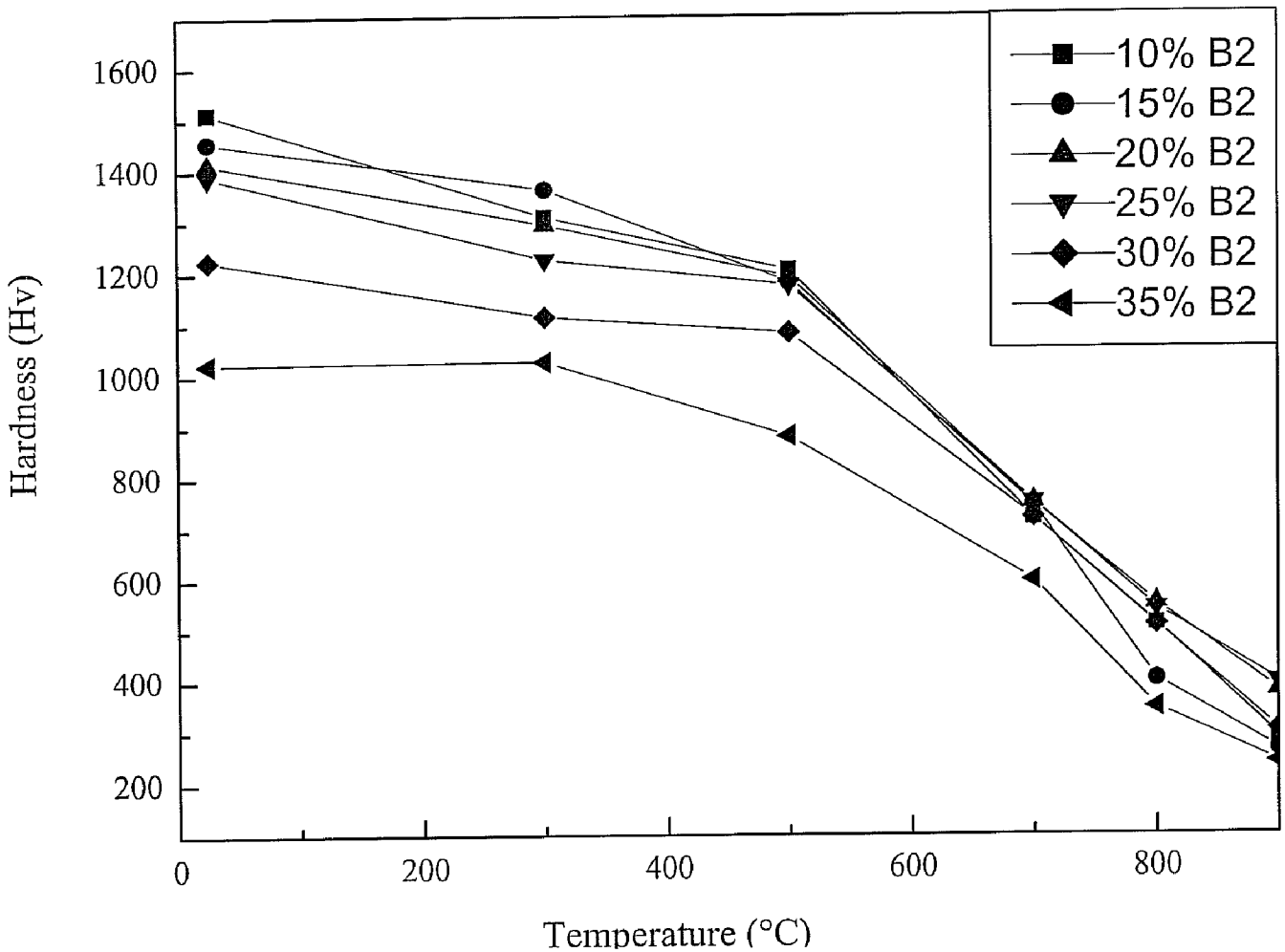
FIG. 5 shows hardness versus temperature curves of different testing samples.

After green compacting and sintering the mixtures, the testing samples were obtained. The density, hardness at room temperature, and grinding resistance of the testing samples composed of different ratios of B2 powder and WC powder were tabulated as in Table 6. Table 6 shows that the testing samples with lower WC ratios had lower hardness at room temperature and grinding resistance. FIG. 5 shows the hardness versus temperature curves of different testing samples. Referring to FIG. 5, it is shown that the lower the WC ratio is, the lower the hardness is. The same phenomenon can be seen with other B serial alloys, mixed and sintered with different WC powder ratios. Accordingly, the ratios of the multi-element high-entropy alloys of the invention can be adjusted to modify the composite hardness for different applications. In addition, because of the high ratio of chromium and nickel of the B serial multi-element high-entropy alloy, the composite has high anti-corrosive properties. Furthermore, because of the aluminum of the B serial multi-element high-entropy alloy, a dense aluminum oxide film is formed on the surface of the composite, thereby improving the thermal resistance of the composite. Therefore, the ultra-hard composite materials in Example 2 are suitable for use in corrosive and high temperature conditions.

TABLE 6

| Testing sample No. | B2 alloy powder ratio (wt %) | WC powder ratio (wt %) | density ($g/cm^3$) | Hardness (Hv) | Grinding resistance ($m/mm^3$) |
|---|---|---|---|---|---|
| B2W-10 | 10 | 90 | 12.71 | 1512 | 38 |
| B2W-15 | 15 | 85 | 12.28 | 1455 | 24 |
| B2W-20 | 20 | 80 | 11.92 | 1413 | 10 |
| B2W-25 | 25 | 75 | 11.55 | 1389 | 7 |
| B2W-30 | 30 | 70 | 11.27 | 1225 | 5 |
| B2W-35 | 35 | 65 | 10.79 | 1023 | 4 |

Example 3

Figure 6:
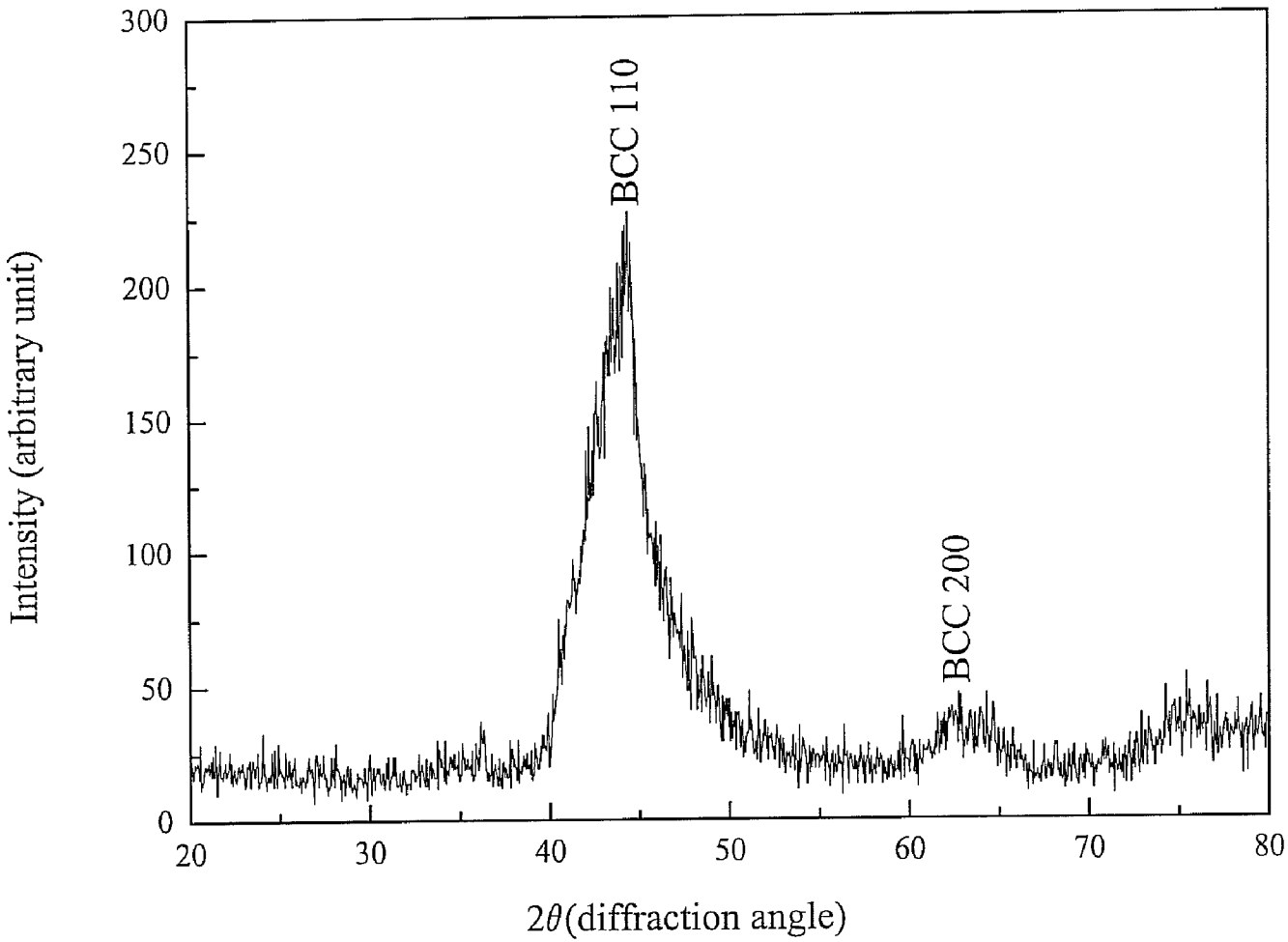
FIG. 6 shows the X-ray diffraction diagram of the multi-element high-entropy alloy powder C1.

FIG. 1 also shows the sintering processes of Example 3. Element powders such as carbon, chromium, nickel, titanium, and vanadium were ball grinded to form multi-element high-entropy alloy powders. The component ratio of C1 alloy was tabulated as in Table 7. FIG. 6 shows an X-ray diffraction diagram of alloy C1, whereby the alloy powder was completely alloyed as a single BCC phase solid solution after ball grinding.

TABLE 7

| Alloy serial No. | component | C | Cr | Ni | Ti | V |
|---|---|---|---|---|---|---|
| C1 | Molar ratio | 0.3 | 1 | 2 | 1 | 1 |
| | Molar percentage | 5.70 | 18.86 | 37.72 | 18.86 | 18.86 |

The sintering density and hardness in room temperature of the testing samples composed of different ratios of Cl alloy powder and WC powder sintered at different temperatures were tabulated as in Table 8. For example, for the testing sample of 20% Cl alloy and 80% WC powder, the hardness of the testing sample reached HV 1825. For example, for the testing sample of 15% Cl alloy and 85% WC powder, the hardness of the testing sample reached Hv 1972. The hardness differences can be controlled by different component ratios for different requirements.

TABLE 8

| Testing sample No. | C1 alloy powder ratio (%) | WC powder ratio (%) | Sintering temperature (° C.) | Density ($g/cm^3$) | Hardness (Hv) |
|---|---|---|---|---|---|
| C1W-151 | 15 | 85 | 1375 | 12.00 | 1633 |
| C1W-152 | 15 | 85 | 1425 | 11.56 | 1972 |
| C1W-153 | 15 | 85 | 1450 | 12.13 | 1732 |
| C1W-201 | 20 | 80 | 1280 | 12.19 | 1366 |
| C1W-202 | 20 | 80 | 1320 | 12.45 | 1825 |
| C1W-203 | 20 | 80 | 1385 | 12.18 | 1302 |

Example 4

Figure 7:
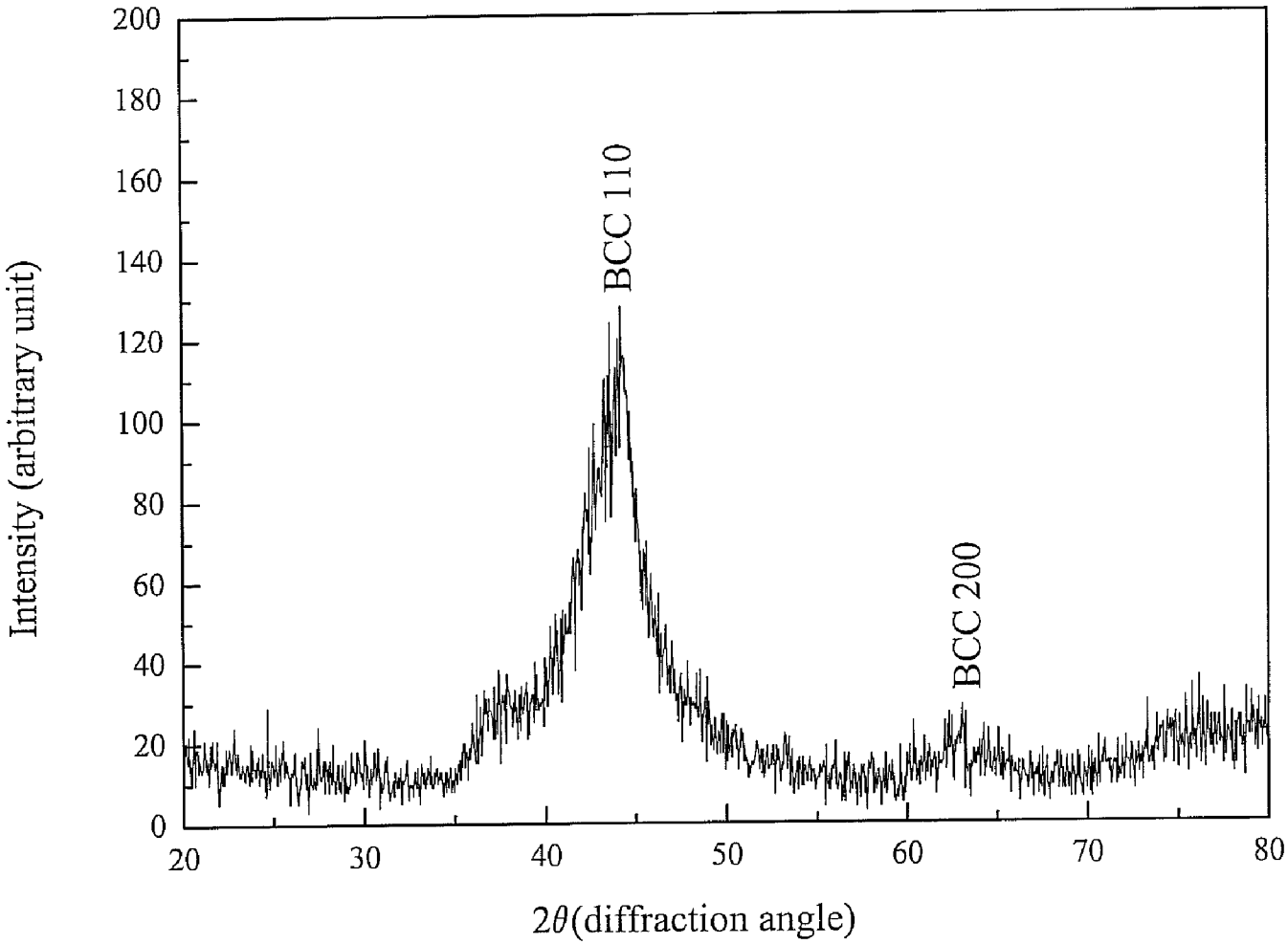
FIG. 7 shows the X-ray diffraction diagram of the multi-element high-entropy alloy powder D1.

FIG. 1 also shows the sintering processes of Example 4. Element powders such as carbon, chromium, iron, titanium, and vanadium were ball grinded to form multi-element high-entropy alloy powders. The component ratio of D1 alloy was tabulated as in Table 9. FIG. 7 shows an X-ray diffraction diagram of alloy D1, whereby the alloy powder D1 was completely alloyed as a single BCC phase solid solution after ball grinding.

TABLE 9

| Alloy serial No. | component | C | Cr | Fe | Ti | V |
|---|---|---|---|---|---|---|
| D1 | Molar ratio | 0.3 | 1 | 2 | 1 | 1 |
| | Molar percentage | 5.70 | 18.86 | 37.72 | 18.86 | 18.86 |

The sintering density and hardness in room temperature of the testing samples composed of different ratios of D1 alloy powder and WC powder sintered at different temperatures were tabulated as in Table 10. The hardness differences can be controlled by different component ratios for different requirements.

TABLE 10

| Testing sample No. | D1 alloy powder ratio (%) | WC powder ratio (%) | Sintering temperature (° C.) | Density ($g/cm^3$) | hardness (Hv) |
|---|---|---|---|---|---|
| D1W-151 | 15 | 85 | 1375 | 11.64 | 2224 |
| D1W-152 | 15 | 85 | 1425 | 11.65 | 2278 |
| D1W-153 | 15 | 85 | 1450 | 11.58 | 2278 |
| D1W-201 | 20 | 80 | 1385 | 11.93 | 1971 |
| D1W-202 | 20 | 80 | 1450 | 11.76 | 2033 |

Example 5

Figure 8:
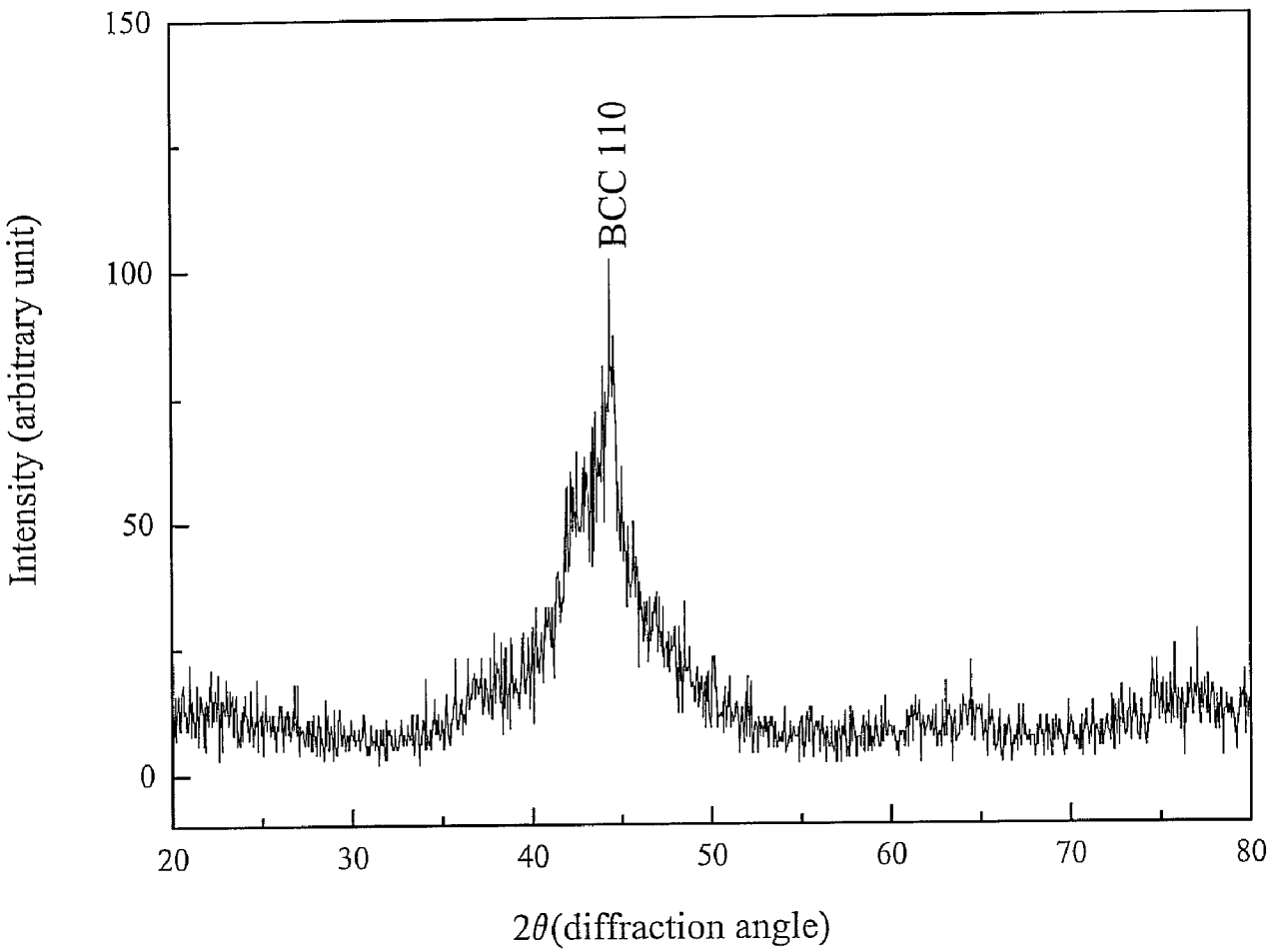
FIG. 8 shows the X-ray diffraction diagram of the multi-element high-entropy alloy powder E1.

FIG. 1 also shows the sintering processes of Example 5. Element powders such as carbon, chromium, cobalt, titanium, and vanadium were ball grinded to form multi-element high-entropy alloy powders. The component ratio of E1 alloy was tabulated as in Table 11. FIG. 8 shows an X-ray diffraction diagram of alloy E1, whereby the alloy powder E1 was completely alloyed as a single BCC phase solid solution after ball grinding.

TABLE 11

| Alloy serial No. | component | C | Cr | Co | Ti | V |
|---|---|---|---|---|---|---|
| E1 | Molar ratio | 0.3 | 1 | 2 | 1 | 1 |
| | Molar percentage | 5.70 | 18.86 | 37.72 | 18.86 | 18.86 |

The sintering density and hardness in room temperature of the testing samples composed of 15 wt % E1 alloy powder and 85% WC powder sintered at different temperatures were tabulated as in Table 12. The hardness differences can be controlled by different component ratios for different requirements.

TABLE 12

| Testing sample No. | D1 alloy powder ratio (%) | WC powder ratio (%) | Sintering temperature (° C.) | density (g/cm$^3$) | hardness (Hv) |
|---|---|---|---|---|---|
| E1W-151 | 15 | 85 | 1425 | 11.95 | 2213 |
| E1W-152 | 15 | 85 | 1450 | 12.38 | 2318 |

Example 6

Figure 9:
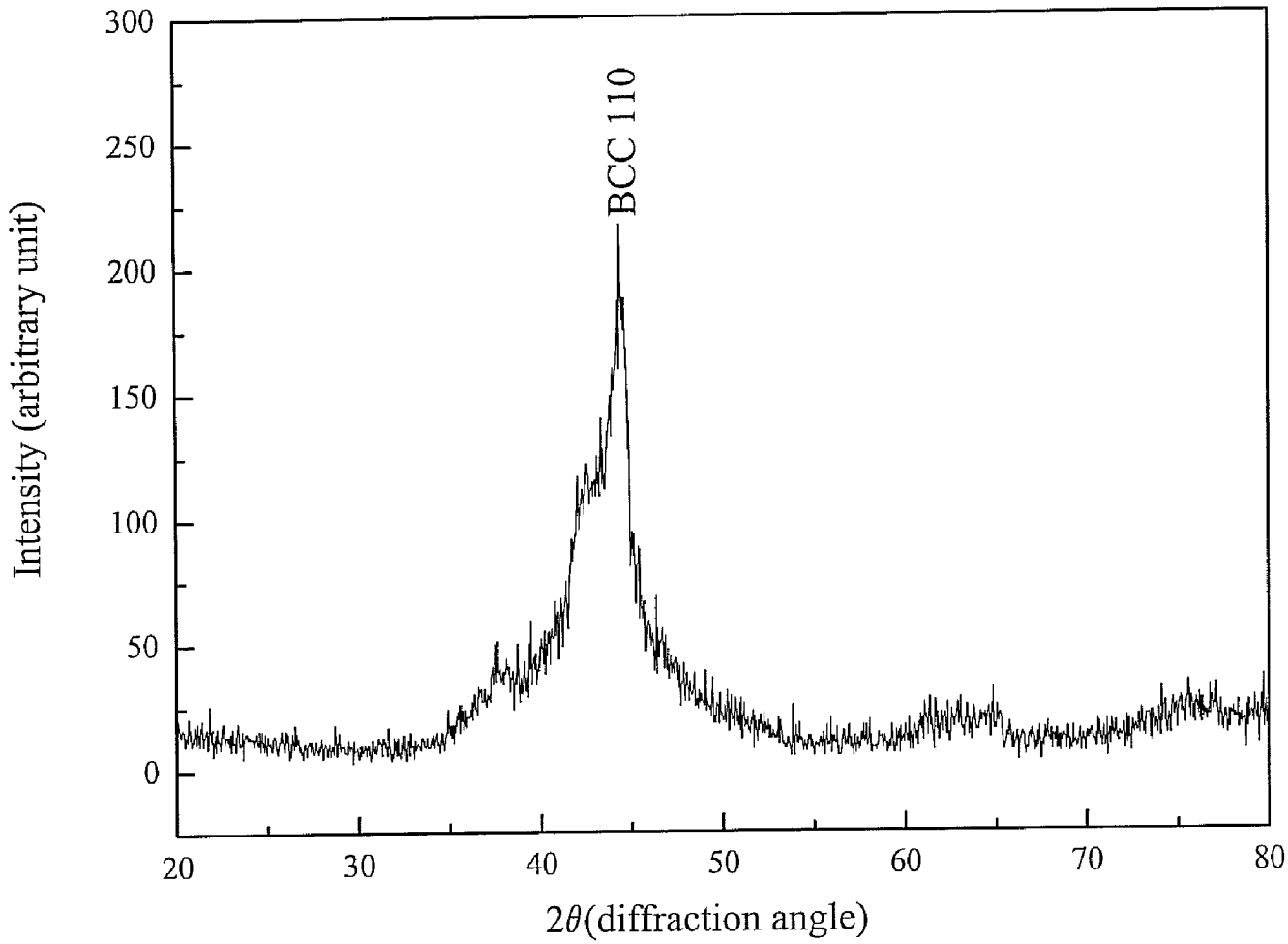
FIG. 9 shows the X-ray diffraction diagram of the multi-element high-entropy alloy powder F1.

FIG. 1 also shows the sintering processes of Example 6. Element powders such as carbon, chromium, iron, nickel, titanium, and vanadium were ball grinded to form multi-element high-entropy alloy powders. The component ratio of F1 alloy was tabulated as in Table 13. FIG. 9 shows an X-ray diffraction diagram of alloy F1, whereby the alloy powder F1 was completely alloyed as a single BCC phase solid solution after ball grinding.

TABLE 13

| Alloy serial No. | component | C | Cr | Fe | Ni | Ti | V |
|---|---|---|---|---|---|---|---|
| F1 | Molar ratio | 0.3 | 1 | 1 | 1 | 1 | 1 |
| | Molar percentage | 5.70 | 18.86 | 18.86 | 18.86 | 18.86 | 18.86 |

The sintering density and hardness in room temperature of the testing samples composed of 15 wt % F1 alloy powder and 85% WC powder sintered at different temperatures were tabulated as in Table 14. The hardness differences can be controlled by different component ratios for different requirements.

TABLE 14

| Testing sample No. | D1 alloy powder rtio (%) | WC powder rtio (%) | Sintering temperature (° C.) | Density (g/cm$^3$) | Hardness (Hv) |
|---|---|---|---|---|---|
| F1W-151 | 15 | 85 | 1375 | 11.85 | 1907 |
| F1W-152 | 15 | 85 | 1425 | 12.15 | 2050 |
| F1W-153 | 15 | 85 | 1450 | 11.95 | 1791 |

Example 7

FIG. 1 also shows the sintering processes of Example 7. The binder metal in Example 7 was the high-entropy alloy powder B2 of Example 2, and the ceramic phase powder was TiC powder. The hardness in room temperature of the testing samples composed of different ratio of B2 alloy powder and TiC powder sintered in 1350° C. were tabulated as in Table 15. The hardness differences can be controlled by different component ratios for different requirements.

TABLE 15

| Testing sample No. | Alloy powder weight ratio | TiC powder weight ratio | Hardness (Hv) |
|---|---|---|---|
| B2T-10 | 10% B2 | 90% | 1176 |
| B2T-15 | 15% B2 | 85% | 1705 |
| B2T-20 | 20% B2 | 80% | 1937 |
| B2T-25 | 25% B2 | 75% | 1774 |
| B2T-40 | 40% B2 | 60% | 1678 |
| B2T-60 | 60% B2 | 40% | 1266 |

Example 8

FIG. 1 also shows the sintering processes of Example 8. Element powders such as cobalt, chromium, iron, nickel, and titanium were ball grinded to form multi-element high-entropy alloy powders. The component ratio of G1 alloy was tabulated as in Table 16.

TABLE 16

| Alloy serial No. | Component | Co | Cr | Fe | Ni | Ti |
|---|---|---|---|---|---|---|
| G1 | Molar ratio | 1.5 | 1 | 1 | 1.5 | 0.5 |
| | Molar percentage | 27.27 | 18.18 | 18.18 | 27.27 | 9.10 |

The hardness in room temperature of the testing samples composed of different ratio of G1 alloy powder and TiC powder sintered in 1380° C. were tabulated as in Table 17. The hardness differences can be controlled by different component ratios for different requirements. In addition, because of the high ratio of chromium and nickel of alloy G1, the testing samples were highly anti-corrosive and anti-oxidative at a high temperature, such that the testing samples are suitable for use under corrosive and high temperature condition.

TABLE 17

| Testing sample No. | Alloy powder weight ratio | TiC powder weight ratio | Hardness (Hv) |
|---|---|---|---|
| G1T-10 | 10% G1 | 90% | 1884 |
| G1T-15 | 15% G1 | 85% | 1754 |
| G1T-20 | 20% G1 | 80% | 1876 |
| G1T-30 | 30% G1 | 70% | 1525 |
| G1T-40 | 40% G1 | 60% | 1223 |
| G1T-60 | 60% G1 | 40% | 809 |

Example 9

The hardness (Hv) and fracture toughness ($K_{IC}$) of the testing samples, C1W and D1W, and commercial available WC, F10 and LC106, were measured and further compared as in Table 18. The testing samples have higher hardness and fracture toughness than the commercially available WC. Compared to conventional WC ultra composite materials, the WC/multi element high-entropy alloy ultra-hard composite materials of the invention have higher hardness and fracture toughness.

TABLE 18

| Testing sample No. | | Averaged hardness (Hv) | Averaged $K_{IC}$ |
|---|---|---|---|
| Commercial available WC | F10 | 1859 | 13.77 |
| | LC106 | 1768 | 13.73 |

TABLE 18-continued

| Testing sample No. | | Averaged hardness (Hv) | Averaged $K_{IC}$ |
|---|---|---|---|
| Composite of WC and high-entropy alloy | C1W | 1931 | 14.29 |
| | D1W | 2162 | 14.08 |

Accordingly, the multi-element high-entropy alloy, serves as a binder metal mixing with the carbide ceramic phase powder, and is processed by mechanical alloying and liquid-phase sintering, to form the ultra-hard composite material of the invention. By selecting appropriate elements, ceramic phase powders, and process conditions, an ultra-hard composite material is provided with different hardness, grinding resistance, anti-corrosiveness, anti-oxidation, and toughness, while hardening at room temperature or high temperature, thus widening application of the ultra-hard composite material.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for manufacturing an ultra-hard composite material, comprising:

mixing a ceramic phase powder consisting of only one metal carbide and a multi-element high-entropy alloy powder to form a mixture;

green compacting the mixture; and sintering the mixture to form an ultra-hard composite material, wherein the multi-element high-entropy alloy powder consists of 5 to 11 elements, with every principal element occupying a 5 to 35 molar percentage of the multi-element high-entropy alloy powder.

2. The method as claimed in claim 1, wherein the step for forming the mixture comprises mechanical alloying.

3. The method as claimed in claim 1, wherein the step for sintering the mixture is processed in a vacuum chamber.

4. The method as claimed in claim 1, wherein the step for sintering the mixture is processed under a mixing gas of argon and hydrogen.

5. The method as claimed in claim 1, wherein the metal carbide comprises tungsten carbide or titanium carbide.

6. The method as claimed in claim 1, wherein the elements are selected from carbon group, aluminum group, chromium group, cobalt group, copper group, iron group, nickel group, vanadium group, or manganese group.

7. The method as claimed in claim 1, wherein the ceramic phase powder and the multi-element high-entropy alloy powder have a weight ratio of 95:5 to 60:40.

8. An ultra-hard composite material, comprising:

(a) a ceramic phase powder consisting of only one metal carbide; and (b) a multi-element high-entropy alloy powder, wherein the multi-element high-entropy alloy powder consists of 5 to 11 elements, with every principal element occupying a 5 to 35 molar percentage of the multi-element high-entropy alloy powder.

9. The ultra-hard composite material as claimed in claim 8, wherein the metal carbide comprises tungsten carbide or titanium carbide.

10. The ultra-hard composite material as claimed in claim 8, wherein the elements are selected from carbon group, aluminum group, chromium group, cobalt group, copper group, iron group, nickel group, vanadium group, or manganese group.

11. The ultra-hard composite material as claimed in claim 8, wherein the ceramic phase powder and the multi-element high-entropy alloy powder have a weight ratio of 95:5 to 60:40.

12. The ultra-hard composite material as claimed in claim 8, wherein the ultra-hard composite material has a hardness of Hv 800 to Hv 2400.

* * * * *